313-422 SR
4/22/80 OR 4,199,705

United States Patent [19] [11] 4,199,705
Anderson et al. [45] Apr. 22, 1980

[54] MODULATOR STRUCTURE FOR A FLAT PANEL DISPLAY DEVICE

[75] Inventors: Charles H. Anderson, Rocky Hill; Louis S. Cosentino, Belle Mead, both of N.J.

[73] Assignee: RCA Corporation, New York, N.Y.

[21] Appl. No.: 966,564

[22] Filed: Dec. 4, 1978

[51] Int. Cl.[2] ..... H01J 29/52; H01J 29/90
[52] U.S. Cl. ..... 313/422; 313/477 R
[58] Field of Search ..... 313/422, 495, 477

[56] References Cited

U.S. PATENT DOCUMENTS

| | | | |
|---|---|---|---|
| 4,031,427 | 6/1977 | Stanley | 313/422 |
| 4,034,255 | 7/1977 | Catanese et al. | 313/422 X |
| 4,088,920 | 5/1978 | Siekanowicz et al. | 313/422 |
| 4,103,205 | 7/1978 | Credelle | 313/422 |
| 4,121,130 | 10/1978 | Gange | 313/409 X |
| 4,128,784 | 12/1978 | Anderson | 313/422 |

*Primary Examiner*—Palmer C. Demeo
*Attorney, Agent, or Firm*—E. M. Whitacre; G. H. Bruestle; V. J. Coughlin

[57] ABSTRACT

In a display device a modulator structure may be formed by disposing on a surface of the back wall a plurality of first control electrodes. A modulator member having a smoothly continuous surface has disposed thereon a plurality of second control electrodes. The surfaces of the back wall and the top member having the electrodes thereon are joined together to form opposing pairs of control electrodes.

5 Claims, 6 Drawing Figures

MODULATOR STRUCTURE FOR A FLAT PANEL DISPLAY DEVICE

BACKGROUND OF THE INVENTION

The present invention relates to a flat panel display device having electron beam guides and particularly to a display device which includes means for modulating the electron beams.

U.S. Pat. No. 4,031,427 to T. O. Stanley, issued June 21, 1977, entitled "Flat Cathode Ray Tube" describes a flat cathodoluminescent display device which includes in an evacuated envelope, beam guides extending along the back wall of the envelope, and a gun structure which generates electrons and directs the electrons as beams into the beam guides. The beam guides confine and focus the electrons in the beams as the beams travel along paths parallel to the front wall of the envelope. The beams may be selectively deflected toward a phosphor screen on the front wall at selected points along the paths of the beams.

U.S. Pat. No. 4,088,920 to W. W. Siekanowicz et al., issued May 9, 1978, entitled "Flat Display Device with Beam Guide" describes a beam guide for use in the display device of the type described in U.S. Pat. No. 4,031,427. The beam guide includes a pair of spaced, parallel plates extending along and spaced from the back wall of the envelope. The plates have a plurality of aligned openings therethrough with the openings being arranged in rows extending longitudinally along the paths of the beams. Each longitudinal row of the openings constitutes a separate beam guide.

U.S. Pat. No. 4,121,130 of R. A. Gange, issued on Oct. 17, 1978, entitled "Cathode Structure and Method of Operating the Same", and copending applications for U.S. Patents, Ser. No. 835,772 of C. H. Anderson, filed Sept. 22, 1977, entitled "Beam Guide for Display Device with Beam Injection Means", now Pat. No. 4,128,784, and Ser. No. 921,267 of C. H. Anderson et al., filed July 3, 1978, assigned to the same assignee as the instant application, entitled "Guided Beam Display Device", disclose gun structures for use in the display device of the type described in U.S. Pat. No. 4,031,427. The gun structures include a line cathode having a plurality of modulation electrodes spaced along the line cathode. Potentials applied to the modulation electrodes cause the electrons generated by the cathode to be emitted therefrom in the form of beams. The gun structures may include isolation electrodes between the modulation electrodes to assist in confining and guiding the beams emitted from the gun structures into the beam guides.

In the gun structure of the Anderson application, Ser. No. 835,772, the modulation electrodes must be accurately dimensioned and positioned with respect to the beam guides. Tabs which are aligned with a separate longitudinal row of openings in the beam guide plates project from the ends of the beam guide plates adjacent the gun structure and allow the creation of an acceleration field which draws electrons between the guide plates and along the longitudinal row of guide plates openings. However, if the edges of the two overlapping modulation electrodes which face the guides do not have a similar contour and are not equidistant from the guide, the beam will be pulled off center and will not enter the guide properly. Therefore, during the fabrication of the display device, the modulation electrodes must be positioned with a high degree of accuracy.

In the gun structure of the Anderson et al. application Ser. No. 921,267, the modulation electrodes and isolation electrodes partially overlap the beam guide to eliminate the deleterious effects of differences in the contour or misalignment of the edges of the overlapping electrodes.

In each of the above-indicated copending applications, and in the Gange patent, the modulation and isolation electrodes are mounted on discrete pads on the walls of a U-shaped support which opens toward the beam guide. The electrodes comprise a layer of tantalum deposited on the pads. The accuracy with which beams of electrons enter the guide is determined by the accuracy with which the opposing pads and tantalum electrodes deposited thereon are aligned.

SUMMARY OF THE INVENTION

A display device includes an evacuated envelope with substantially parallel front and back walls. Within the envelope is a line cathode across one end of a beam guide. Opposing pairs of first and second control electrodes partially overlap the beam guide. A modulator member having a smoothly continuous surface which includes two substantially flat portions which lie in spaced apart parallel planes with second control electrodes thereon is attached to the back wall of the device on which are disposed first control electrodes thereby achieving registration and electrical connection of opposing pairs of first and second control electrodes.

DETAILED DESCRIPTION OF THE PREFERRED EMBODIMENT

Figure 1:
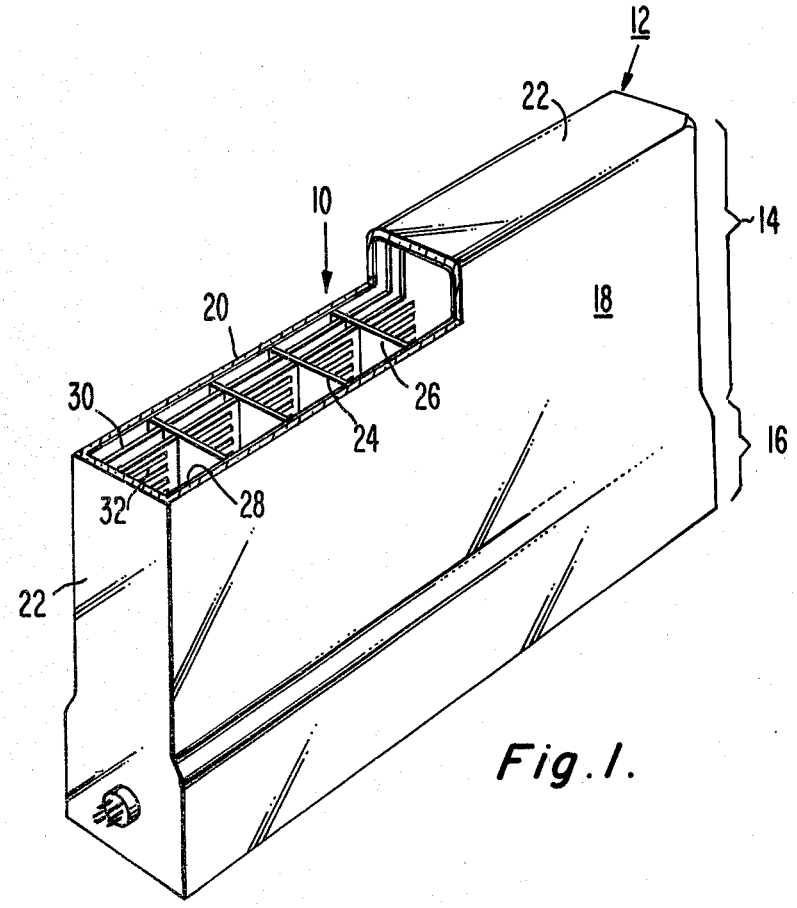
FIG. 1 is a perspective view, partially broken away, of a flat display device into which the present invention can be incorporated.

Referring to FIGS. 1–4, one form of a flat display device of the present invention is generally designated as 10. The display device 10 comprises an evacuated envelope 12, typically of glass, having a display section 14 and an electron gun section 16. The envelope 12 includes a rectangular front wall 18 and a rectangular back wall 20 in spaced parallel relation with the front wall 18. The front wall 18 and the back wall 20 are connected by four side walls 22.

A plurality of spaced, parallel support walls 24, are secured between the front wall 18 and the back wall 20 and extend from the gun section 16 to the opposite side wall 22. The support walls 24 provide the desired internal support against external atmospheric pressure and divide the display section 14 into a plurality of channels 26. On the inner surface of the front wall 18 is a screen 28 composed of cathodoluminescent elements which may be of any well known type presently used in cathode ray tubes. In a color display, for example, the phosphor screen in each of the channels 26 alternate between red, green, and blue light-emitting phosphor strips or elements.

Figure 2:
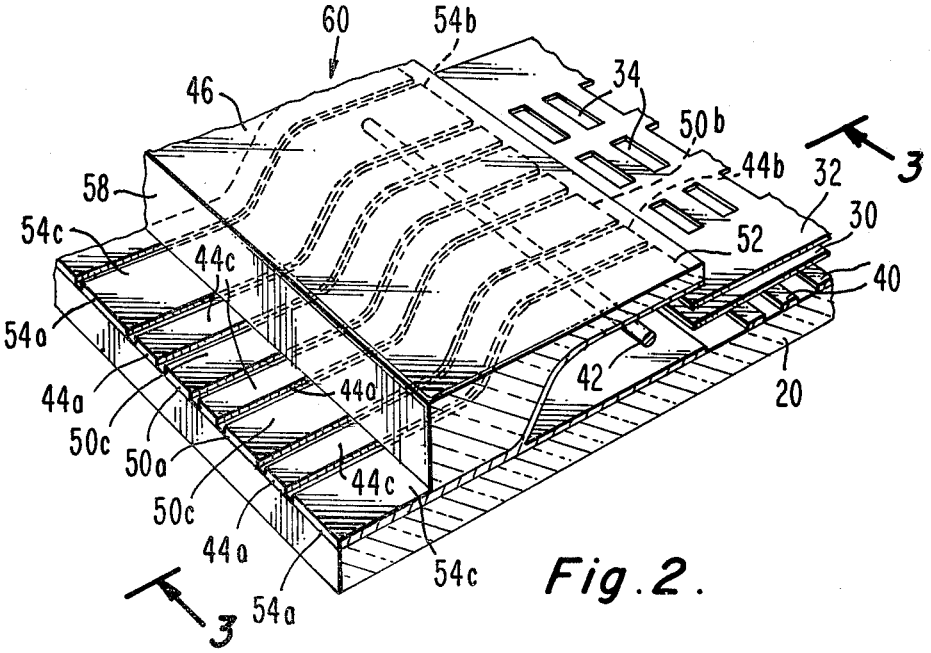
FIG. 2 is a perspective view of a portion of the modulator structure, line cathode, and beam guide of the display device of FIG. 1.

In each of the channels 26 is a beam guide assembly of the type described in the previously referred to Siekanowicz et al. patent. As shown in FIG. 2, each of the beam guide assemblies includes a pair of spaced, parallel beam guide plates 30 and 32 extending transversely across the channel 26. Although not shown in FIG. 2, the guide plates 30 and 32 also extend longitudinally along the channel from the gun section 16 to the opposite side wall 22. The first beam guide plate 30 is adjacent and parallel to the back wall 20 of the envelope 12 and the second beam guide plate 32 is between the first beam guide plate 30 and the front wall 18. The second beam guide plate 32 has a plurality of openings 34 therethrough with the openings being arranged in rows transverly across and longitudinally along the channel 26. The first beam guide plate 30 has similar openings therethrough (not shown) with each of the openings in the first beam guide plate 30 being in alignment with a separate opening 34 in the second beam guide plate 32. Each pair of longitudinal rows of the openings in the beam guide plates forms a separate electron beam guide along the channel 26.

A plurality of spaced, parallel conductors 40 are on the back wall 20. The conductors 40 extend transversely across the channels 26 with each conductor 40 extending along a separate transverse row of the openings in the beam guide plates 30 and 32. The conductors 40 are strips of an electrically conductive metal coated on or bonded to the back wall 20.

Figure 3:
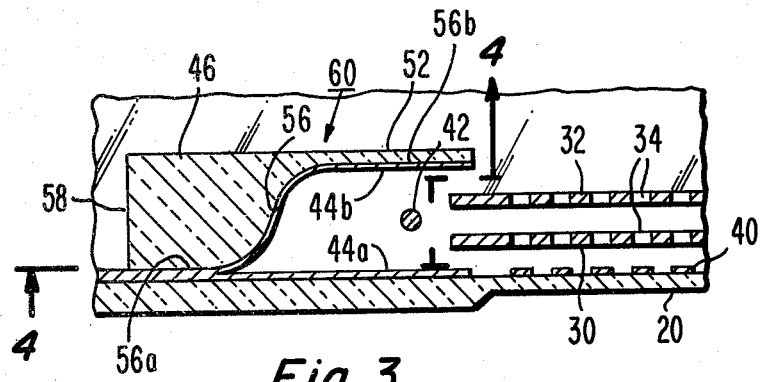
FIG. 3 is a sectional view through a portion of the modulator structure, line cathode, and beam guide of FIG. 2 taken along line 3—3.

In the gun section 16 of the envelope 12 is a modulator structure 60 of the present novel design. As shown in FIGS. 2 and 3, the gun section 16 includes a conventional line cathode 42 of a filament of a metal which will withstand high temperatures, such as tungsten, coated with an emissive material, such as emissive oxides. One example of suitable emissive oxides are those formed from a mixture of about 13% calcium carbonate, 31% strontium carbonate and 56% barium carbonate which is heated to convert the carbonates to the oxides. The cathode 42 extends transversely across the end of at least one of the channels 26 and is positioned in a plane which is parallel and between the planes of the beam guide plates 30 and 32. The cathode 42 is held under tension, such as by springs (not shown) at the ends of the cathode. There may be separate cathodes across each of the channels 26, across several of the channels 26, or a single cathode across all of the channels.

The modulator structure 60 includes the back wall 20 of the device on which is disposed a plurality of discrete, interleaved control electrodes which include first modulation electrodes **44*a* and first isolation electrodes 50*a*. The first electrodes 44*a* and 50*a* are parallel to each other and extend from an edge of the back wall 20 toward and perpendicular to the conductors 40. The first electrodes extend across the back wall 20 a distance sufficient to partially overlap an end of the beam guide grid 30 without overlapping any of the openings 34 in the grid 30. A first isolation electrode 54*a*, wider than the first isolation electrode 50*a*, may be located at each end of the back wall 20 and between each triplet of first modulation electrodes 44*a***.

The modulator structure 60 further includes a modulator member 46 having a substantially planar surface 52 disposed opposite from a smoothly curved, continuous surface 56 which includes two substantially flat portions **56*a* and 56*b* which lie in spaced apart parallel planes. A plurality of discrete, interleaved control electrodes which include second modulation electrodes 44*b* and second isolation electrodes 50*b* are disposed on the curved surface 56**.

Figure 4:
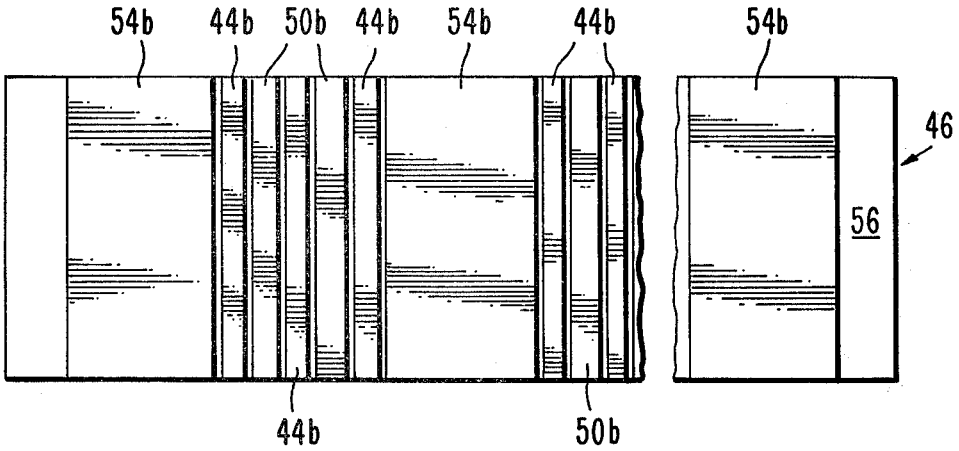
FIG. 4 is a bottom view of the modulator member of FIG. 3 taken along line 4—4.

Referring to FIG. 4, there is shown a bottom view of the modulation and isolation electrode pattern on the curved surface 56 of the modulator member 46. The second modulation electrodes **44*b* form spaced electrode triplets since in a color display three beams of electrons may be generated and injected into each beam guide. Between the second modulation electrodes 44*b* and electrically spaced therefrom are the second isolation electrodes 50*b*. A second isolation electrode 54*b*, wider than the second isolation electrodes 50*b*, may be located at each end of the curved surface 56 and between each triplet of second modulation electrodes 44*b*. Typical widths of the various elements are as follows: isolation electrodes 50*b*, 100 mils (2.54 mm); isolation electrode 54*b*, 524 mils (13.31 mm); modulation electrodes 44*b*, 80 mils (2.03 mm); open spacing between adjacent electrodes 10 mils (0.25 mm). Since the second electrodes 44*b* and 50*b* on the modulator member 46 are aligned with and form opposing electrode pairs with the corresponding first electrodes 44*a* and 50*a* on the back wall 20, the widths of the first electrodes on the back wall 20 are identical to those of the second electrodes on the curved surface 56 of modulator member 46. The flat portion 56*a* of curved surface 56 comprises a sealing surface which contacts the back wall 20. The flat distal portion 56*b* of curved surface 56 partially overlaps one end of the beam guide grid 32 without overlapping any of the openings 34 in the grid 32**.

The first modulation and isolation electrodes **44*a* and 50*a* and the second modulation and isolation electrodes 44*b* and 50*b* comprise a mixture of vitreous glass frit, binder, and metal particles such as silver which may be sintered to bring about agglomeration of the vitreous glass frit and the metal particles. Sintering is well-known in the art. A commercially available mixture sold under the trademark DuPont 7713 ink may be used for the electrodes. The electrodes may be formed by any number of well-known techniques such as silk-screening or photolithography. The wider isolation electrodes 54*a* and 54*b* comprise the same mixture of vitreous glass frit, binder, and metal particles which may be sintered to bring about agglomeration of the vitreous glass frit and the metal particles as the isolation electrodes 50*a* and 50*b*. The wider isolation electrodes 54*a* and 54*b* also partially overlap one end of the beam guide and form opposing pairs of electrodes as shown in FIG. 2**.

In a modulator structure 60, the modulator member 46 may be attached to the back wall 20 by thermally bonding together the vitreous glass frit electrodes so that the first and second modulation electrodes **44*a* and 44*b* and the first and second isolation electrodes 50*a* and 50*b* are aligned and registered to form opposing pairs of electrodes. The spacing between opposing pairs of electrodes is typically 102±0.0005 mils (about 2.59±0.013 mm). Since the second modulation and isolation electrodes 44*b*, 50*b* and 54*b* extend across the smoothly curved, continuous surface 56 of the modulator member 46, electrical connection is established between the first and second modulation electrodes 44*a* and 44*b* and between the first and second isolation electrodes 50*a*** and 50*b*, and 54*a* and 54*b* at the interface between the sealing surface 56*a* of the modulator member 46 and the back wall 20. This novel modulator structure 60 provides a single electrode terminal 44*c*, 50*c*, and 54*c* for opposing pairs of electrodes 44*a* and 44*b*, 50*a* and 50*b*, and 54*a* and 54*b*, respectively. As shown in FIG. 2, the electrode termimals 44*c*, 50*c*, and 54*c* which are disposed on the back wall 20 between surface 58 of the modulator member 46 and the edge of the back wall 20 are continuations of the electrodes 44*a*, 50*a*, and 54*a*, respectively.

In the operation of the display device 10, a high positive potential, typically about +300 volts, is applied to each of the conductors 40, and a low positive potential typically about +80 volts is applied to the beam guide plates 30 and 32. A very high positive potential, typically about 8–10 kV is applied to the phosphor screen 28. These potentials are with regard to the potential applied to the cathode 42. As described in the Siekanowicz et al. patent, the potential differences between the beam guide plate 30 and the conductors 40, and between the beam guide plate 32 and the phosphor screen 28 create electrostatic fields which extend into the space between the beam guide plates 30 and 32 and confine electrons into beams flowing between the beam guide plates along each of the longitudinal rows of the openings 34. The beams of electrons can be selectively deflected toward the phosphor screen 28 at selected points along the channels 26 by switching the potential applied to each of the conductors 40 to a negative potential, such as −100 volts. This will cause the beams to be deflected away from the negative conductor so that the beams will pass through the adjacent openings 34 in the beam guide plate 32. The beams will then impinge on the phosphor screen 28 to provide a line scan of the phosphor screen.

The electron beams are generated in the gun section 16 by heating the cathode to its emission temperature typically about 760° C., to cause the cathode to emit electrons. With a potential applied to the modulation electrodes 44*a* and 44*b* sufficiently negative with respect to the potential applied to the cathode 42, typically about 70 volts more negative, the electrons emitted from the cathode will be trapped within the gun structure. When the potential applied to any pair of the modulation electrodes 44*a* 44*b* is switched to a more positive potential, typically, no more positive than about −10 volts, with respect to the cathode, the electrons in the region of such modulation electrodes will flow toward the positively charged beam guide plates 30 and 32 in the form of a beam. The first modulation electrodes 44*a* may be between adjacent first isolation electrodes 50*a* or between first isolation electrodes 50*a* and 54*a* while the second modulation electrodes 44*b* may be between adjacent second isolation electrodes 50*b* or between second isolation electrodes 50*b* and 54*b* depending upon the location of the modulation electrodes with respect to the channel. The isolation electrodes 50*a*, 50*b*, 54*a*, and 54*b*, also extend over the edge of the guide grids 30 and 32. The isolation electrodes 50*a* and 50*b*, and 54*a* and 54*b*, are negatively biased with respect to the cathode, e.g., −100 volts d.c., thereby interspersing negative potential barrier regions along the cathode length. This negative potential superposes with the potential which circumscribes the cathode so that the net field intensity alternates in polarity along the length of the cathode. These alternating segments of field intensity along the length of the cathode 42 serve to form beamlets of electrons which can be independently modulated.

Figure 5:
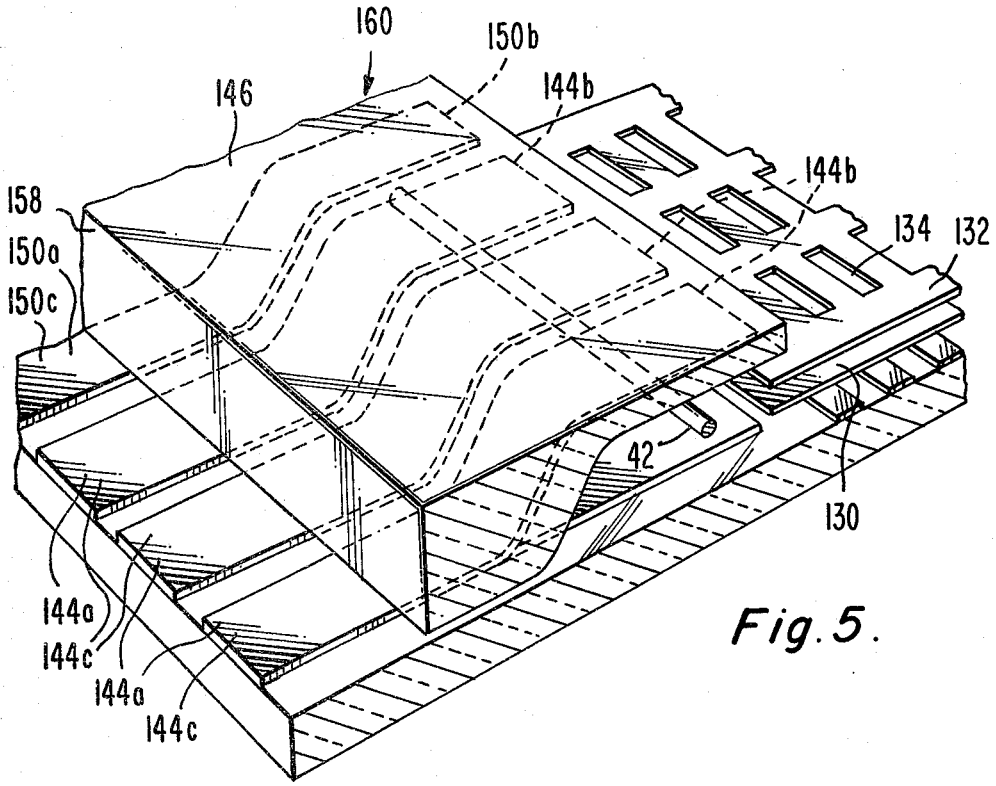
FIG. 5 is a perspective view of a portion of a modulator structure having a different electrode pattern.

FIG. 5 shows a modulator structure 160 having a different control electrode pattern. In this embodiment there are a plurality of opposing pairs of first and second modulation electrodes 144*a* and 144*b* and first and second isolation electrodes 150*a* and 150*b*. The modulator structure 160 is substantially identical to the modulator structure 60 discussed above except that the modulation electrodes 144*a* and 144*b* are substantially wider than the modulation electrodes 44*a* and 44*b* and the pairs of isolation electrodes 150*a* and 150*b* are not interleaved between adjacent pairs of modulation electrodes 144*a* and 144*b*. In the embodiment shown in FIG. 5, the pairs of isolation electrodes 150*a* and 150*b* are located at each end (not shown) of the modulator structure 160 and between adjacent triplets of the modulation electrodes 144*a* and 144*b*. A single electrode terminal 144*c* and 150*c* for each opposing pair of electrodes 144*a* and 144*b*, and 150*a* and 150*b* is disposed on the back wall 20 between surface 158 of modulator member 146 and the edge of the back wall 20. The terminals 144*c* and 150*c* are continuations of the electrodes 144*a* and 150*a* respectively.

Figure 6:
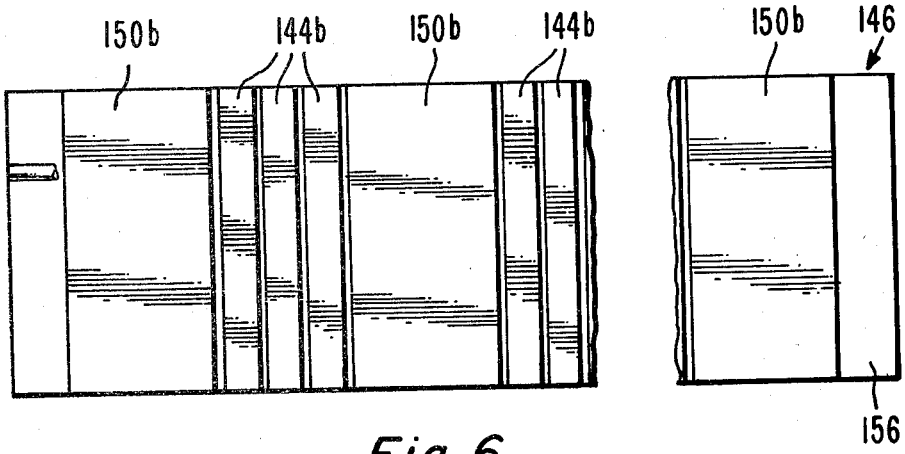
FIG. 6 is a bottom view of the modulator member showing the electrode pattern of FIG. 5.

FIG. 6 shows a bottom view of the different electrode pattern on the curved surface 156 of the modulator member 146. A corresponding electrode pattern is disposed on the back wall 20 so that opposing pairs of first and second modulation electrodes 144*a* and 144*b* and first and second isolation electrodes 150*a* and 150*b* are formed when the modulator member 146 is bonded to the back wall 20.

As shown in FIG. 5, one end of a pair of beam guide plates 130 and 132 having a plurality of aligned openings 134 and tabs (not shown) are partially overlapped by the opposing pairs of the electrodes 144*a* and 144*b*, and 150*a* and 150*b*. The modulation electrodes 144*a* and 144*b* do not overlap any of the openings 134 in the grids 130 and 132.

The tabs (not shown) are identical in structure and operation to the tabs disclosed in the above-mentioned U.S. patent application Ser. No. 835,772 filed Sept. 22, 1977. By making the width of the modulation electrodes 144*a* and 144*b* greater than the transverse dimension of the electron beam, the edges of the modulation electrodes 144*a* and 144*b* play a negligible role in forming the beam and therefore the precision with which the modulation electrodes 144*a* and 144*b* are aligned with the longitudinal rows of the openings 134 in the beam guide plates 130 and 132 is reduced. The tabs, which are at the same potential as the beam guide plates 130 and 132, generate fields which penetrate toward the gun structure to create an acceleration field which draws the electrons between the guide plates 130 and 132, along the longitudinal row of the guide plate openings 134.

I claim:

1. In a display device having an evacuated envelope with substantially parallel front and back walls, an electron beam guide, a plurality of discrete first and second control electrodes forming opposing pairs of electrodes partially overlapping said beam guide, a line cathode extending between said opposing pairs of electrodes across one end of said beam guide, and a cathodoluminescent screen on the front wall, the improvement comprising:

a modulator structure partially overlapping said beam guide comprising in combination, said back wall on which is disposed said discrete first electrodes, a modulator member having a smoothly continuous surface with said discrete second control electrodes thereon, said continuous surface having two substantially flat portions which are in spaced apart parallel planes, said flat portions including a sealing portion and a distal portion; and means for attaching said sealing portion of said modulator member to said back wall so that registration and electrical connection of said opposing pairs of said discrete first and second control electrodes is achieved.

2. A display device in accordance with claim 1 wherein said distal portion of said modulator member is substantially parallel to said back wall.

3. A display device in accordance with claim 2 wherein said first and second control electrodes further comprise modulation and isolation electrodes which are interleaved so that a modulation electrode is between two adjacent isolation electrodes.

4. A display device in accordance with claim 3 wherein the first and second modulation and isolation electrodes further comprise a conductive mixture including vitreous glass frit.

5. A display device in accordance with claim 4 wherein said means for attaching said modulator top member to said back wall includes thermally bonding together the electrodes of said modulator member and said back wall.

* * * * *